United States Patent [19]

Urushizaki

[11] Patent Number: 4,793,536

[45] Date of Patent: Dec. 27, 1988

[54] TAPE CUTTER

[76] Inventor: Sakae Urushizaki, 7-1-1226, Minamihorie 4-chome, Nishi-ku, Osaka, Japan

[21] Appl. No.: 92,218

[22] Filed: Sep. 2, 1987

[30] Foreign Application Priority Data

Oct. 2, 1986 [JP] Japan ..... 61-236705

[51] Int. Cl.[4] ..... B26F 3/02

[52] U.S. Cl. ..... 225/22; 225/72; 225/89

[58] Field of Search ..... 225/22, 72, 89, 73, 225/74, 75

[56] References Cited

U.S. PATENT DOCUMENTS 2,555,187 5/1951 Erhardt ..... 225/22

2,665,078 1/1954 Krueger ..... 225/22

*Primary Examiner*—Paul A. Bell

*Assistant Examiner*—Scott A. Smith

*Attorney, Agent, or Firm*—Spencer & Frank

[57] ABSTRACT

A tape cutter for holding a roll of adhesive tape or the like and cutting the tape pulled out of the roll. After cutting, the tape end is in condition for easy pick-up at the next use without adhering to the cutter or the tape roll. When pulling the tape out of the tape cutter, the tape guide roller is pressed down by the tape so that the cutter holder carrying the tape guide roller will be pivoted to put the cutter into its operative position. After cutting, the cutter support and thus the cutter will get back to their inoperative retracted position.

14 Claims, 3 Drawing Sheets

TAPE CUTTER

BACKGROUND OF THE INVENTION

The present invention relates to a tape cutter for drawing out an adhesive tape or the like to a desired length and cutting it.

The tape cutter is available in either a hand-held type or in a table-top type. In either type, a tape cutter is provided with a tape support for rotatably mounting a roll of adhesive tape so that the tape will be unrolled and pulled out and be pressed against a fixed cutter arranged in the way of feed to cut. Therefore, after cutting the adhesive tape tends to have its leading end stuck to the cutter edge or hanging down to be adhered to the outer periphery of the roll. When pulling out the tape the next time in such a condition, the tape has to be picked out by the portion between the roll and the cutter or the tape end has to be peeled off the roll.

SUMMARY OF THE INVENTION

It is an object of the present invention to provide a tape cutter which obviates the abovesaid shortcomings and which allows a tape to be easily picked by its leading end and pulled out.

In accordance with the present invention, there is provided a tape cutter for holding a roll of tape and cutting the tape while it is pulled out, comprising a case; a tape holder mounted in the case for supporting a roll of tape; a cutter support pivotally mounted in the case adjacent the path of the tape pulled out of the roll of tape; a tape guide roller rotatably mounted on the cutter support near its inner end; a cutter fixedly mounted on the cutter support near its outer end; a stopper means for stopping the cutter support from turning in one direction with the cutter in its inoperative position; and means for biassing the cutter support to such a direction as to put the cutter support into its inoperative position.

An adhesive tape is pulled out from a roll mounted on the support of the tape holder and the tape guide roller is pushed down by the tape. The cutter support carrying the tape guide roller is pivoted to raise the cutter to its operative position. The tape is then pressed against the cutter to be cut.

After cutting, the cutter support is released from the downward pressure and pivots in the opposite direction, urged by a spring. The leading end of the tape is sprung up by the tape guide roller. Since the tape guide roller is disposed behind the cutter, the tape end will stick out into the air. Thus the tape can be readily held by its leading end and pulled out.

BRIEF DESCRIPTION OF THE DRAWINGS

Other features and objects of the present invention will become apparent from the following description taken with reference to the accompanying drawings, in which.

DESCRIPTION OF THE PREFERRED EMBODIMENTS

Figure 1:
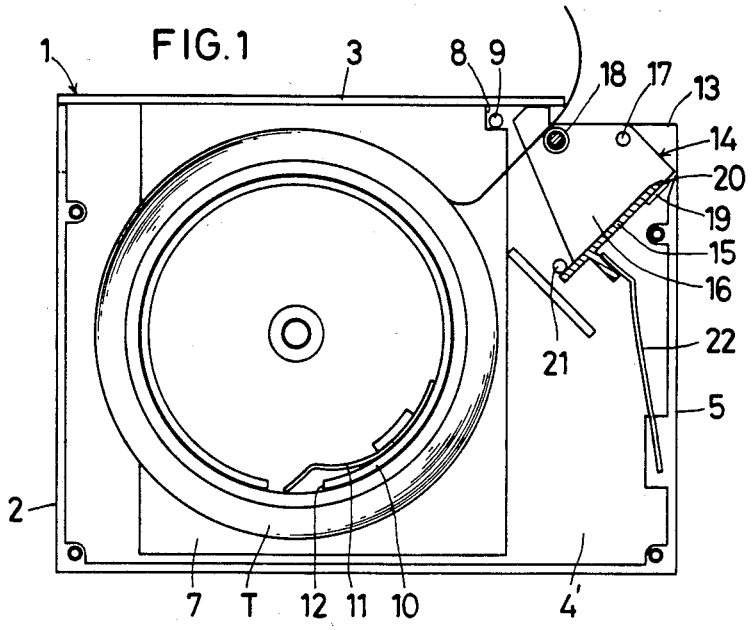
FIG. 1 is a front view of the tape cutter in accordance with the present invention with one side plate removed.
Figure 2:
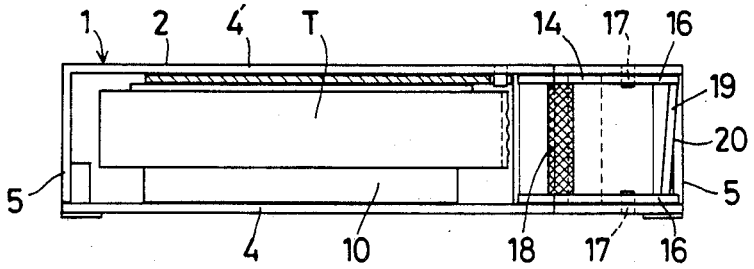
FIG. 2 is a top view of the same with the cover removed.
Figure 3:
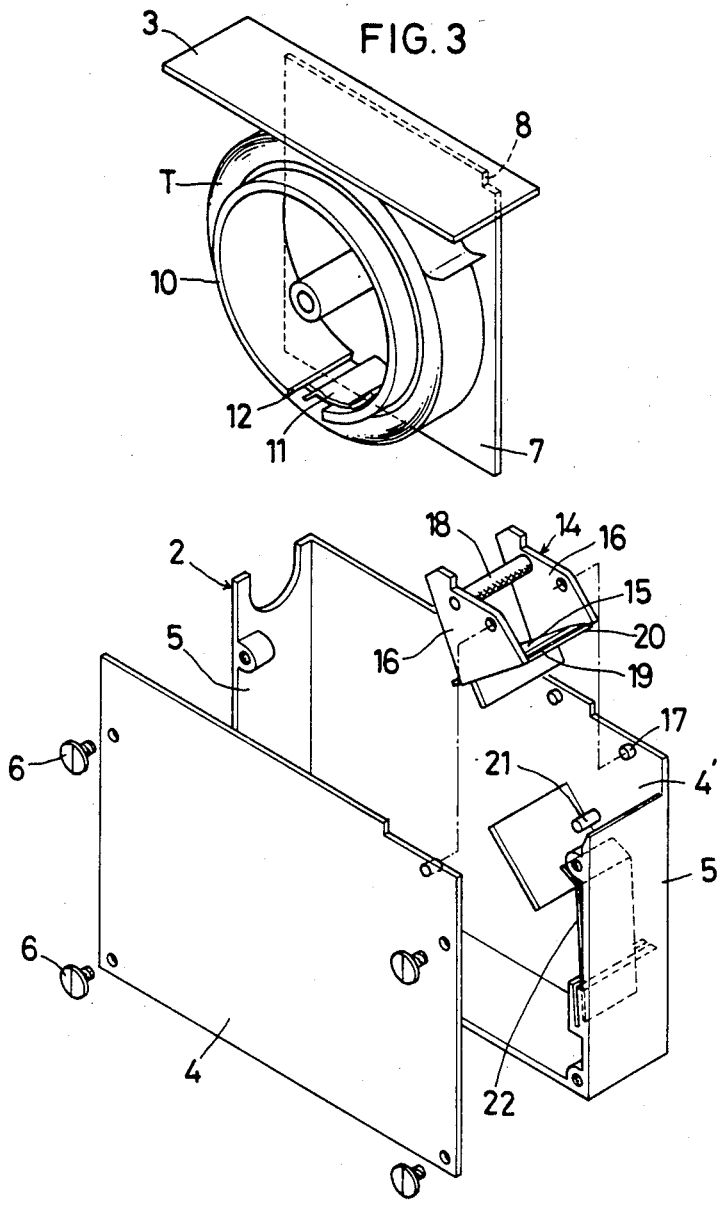
FIG. 3 is an exploded perspective view of the same.

Now referring to the drawings, a tape holder 1 comprises a box-shaped case 2 and a cover 3 for closing the top opening of the case 2, as shown in FIGS. 1 to 3. The case 2 has its one side plate 4 fastened to end plates 5 by means of screws 6. Secured to the bottom of the cover 3 at one side thereof is a tape support plate 7 formed with a cutout 8 in its upper front corner. The cutout 8 is adapted to engage a pin 9 provided on the inner surface of the case 2 to keep the cover 3 from coming off.

The cover 3 can be pulled out of the case 2 together with the tape support plate 7 by moving the cover 3 backwardly to disengage the pin 9 from the cutout 8.

The tape support plate 7 is provided on one side centrally with a tape support cylinder 10 which is provided on its inner periphery with a leaf spring 11 having one end protruding through a slit 12 formed in the cylinder 10. With a roll of adhesive tape T mounted on the cylinder 10, the protruding end of the leaf spring 11 is pressed against the inner periphery of the adhesive tape T, thus holding the tape stably and preventing it from turning except when the adhesive tape T is drawn out.

Although in this embodiment, the cylinder 10 is rotatably mounted on the tape support plate 7 with a suitable resistance to rotation, it may be fixedly mounted on the tape support plate 7. The tape holder 1 is formed with a tape outlet 13 between the upper end of one end plate 5 of the case 2 and one end of the cover 3. Adjacent the tape outlet 13 is arranged a cutter support 14 comprising a cutter support plate 15 and a pair of mounting side plates 16. The cutter support 14 is pivotally supported at its central portion by pins 17 provided on the side plates 4, 4' of the case 2.

A tape guide roller 18 is rotatably mounted between the mounting plates 16 of the cutter support 14 at their rear portion. A cutter 19 is secured to the cutter support plate 15 at its front.

The cutter 19 may be straight-edged or serrated-edged. In either case, the cutter should have its edge not horizontal but oblique to provide a sharp cut.

A stopper pin 21 is arranged adjacent to the cutter support 14 so as to abut against the lower end of the cutter support plate 15 and restrain it from pivoting further. With the cutter support plate 15 in abutment with the stopper pin 21, the cutter 19 is positioned below the tape guide roller 18 and below the upper edge of the end plate 5 of the case 2.

A leaf spring 22 has its bottom end secured to the inner surface of the end plate 5 of the case 2 and its top end coupled to the cutter support 14 to bias the cutter support plate 15 into abutment against the stopper pin 21.

Figure 4:
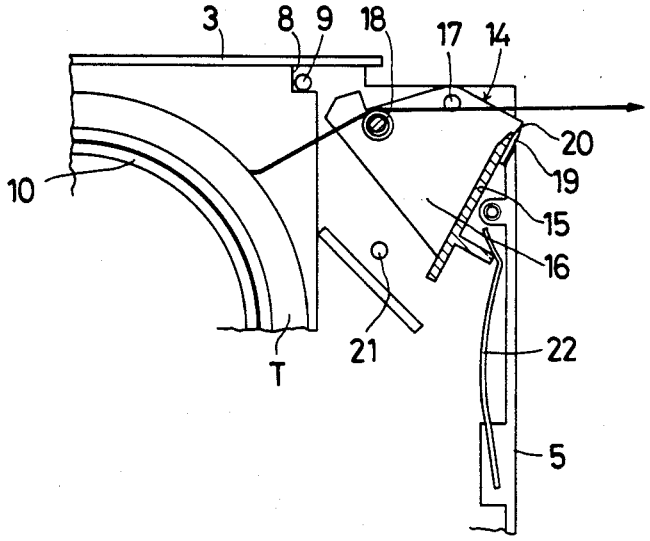
FIGS. 4 and 5 are enlarged sectional views showing how a tape is cut.
Figure 5:
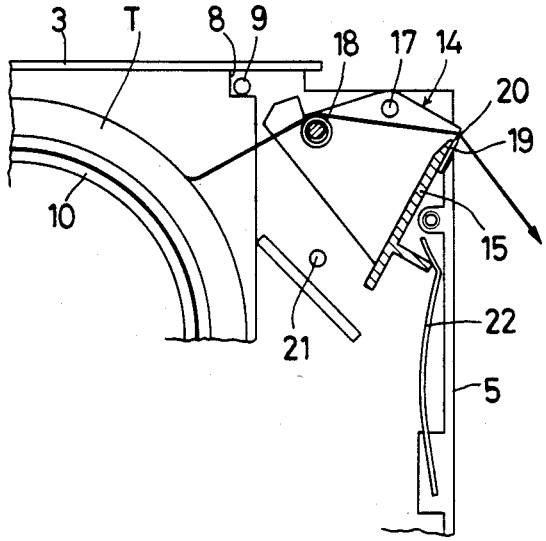

In operation, a roll of adhesive tape T is mounted on the cylinder 10 and the tape T is drawn out through the tape outlet 13, while pushing down the tape guide roller 18. This causes the cutter support 14 to pivot counterclockwise in FIG. 4 so that the edge 20 of the cutter 19 will stick out above the upper edge of the end plate 5.

The tape T is then pressed against the edge of the cutter 19 to cut. Since the cutter support 14 is released from the pressure of the tape after cutting, it pivots back in the opposite direction around the pin 17, urged by the leaf spring 22. With this pivotal movement of the cutter support 14, the end of the tape T will spring up. The tape end gets away from the edge 20 of the cutter 19 and is held supported on the tape guide roller 18.

When pulling out the adhesive tape T next time, it will be readily picked up by finger tips and pulled out.

Some kinds of adhesive tape T tend to be electrostatically charged at its tip when it is pulled out. If the cutter support 14 is flat, the tip of the tape might electrostatically stick to the upper surface of the cutter support 14 after cutting. It is therefore preferable to form the cutter support 14 into a frame-like shape as in the preferred embodiment.

The tape holder may be of either a hand-held type as shown in the preferred embodiment or a tabletop type.

The cutter support 14 is adapted to be prevented from turning beyond a predetermined point by abutment against the stopper pin 21 in this embodiment. But, other stopper mechanisms may be adopted. For example, an arcuate slit may be formed in the mounting plate 16 of the cutter support 14 around the pin 17 so that another pin slidably received in the slit will abut against the ends of the slit, preventing the cutter support from turning beyond a predetermined point.

What I claim:

1. A tape cutter for holding a roll of tape and cutting the tape while it is pulled out, comprising:

a case;

a tape holder mounted in said case for supporting a roll of tape; a cutter support having an inner end and an outer end, pivotally mounted in said case for pivotal movement between an operative position for cutting the tape and an inoperative position, said cutter support being disposed adjacent a path of the tape pulled out of the roll of tape successively past said inner end and said outer end;

a tape guide roller rotatably mounted on and carried by said cutter support near said inner end;

a cutter fixedly mounted on said cutter support near said outer for cutting the tape when the cutter support is in said operative position, such that drawing of the tape along said path downward toward said cutter engages the tape with said roller to pivot said cutter support into said operative position;

a stopper means for stopping said cutter support from turning in one direction with said cutter in said inoperative position;

and means for biassing said cutter support to such a direction as to put said cutter support into said inoperative position.

2. A tape dispenser, comprising:

a case;

tape holder means, mounted in said case, for rotatively supporting a roll of tape for rotation about a roll axis, said case having means defining a path along which the tape can be pulled out from the roll to the exterior of said case;

a cutter support pivotally mounted in said case adjacent said path;

a tape guide roller rotatably mounted on said cutter support along said path so that when the tape is pulled along said path the tape runs on said roller;

a cutter fixedly mounted on said cutter support adjacent said path, said cutter support being pivotable in an arc between an operative position in which said cutter extends upward into said path for cutting the tape and an inoperative position in which said cutter is spaced below said path and such that drawing of the tape along said path downward toward said cutter engages the tape with said roller to pivot said cutter support into said operative position and supports said cutter support in said operative position as the tape is cut by said cutter;

stopper means for stopping said cutter support from pivoting a distance away from said operative position past said inoperative position; and means for elastically biasing said cutter support toward said inoperative position so that said biasing means urges said cutter support to said inoperative position after cutting the tape.

3. A tape dispenser as in claim 2, wherein said cutter support is integrally informed and mounted in said case to pivot about a single axis.

4. A tape dispenser, comprising:

a case;

tape holder means, mounted in said case, for rotatively supporting a roll of tape for rotation about a roll axis;

a cutter support pivotally mounted in said case, said case and said cutter support defining a path along which the tape can be pulled out from the roll to the exterior of said case;

a tape guide roller rotatably mounted on said cutter support along said path on one side of said path;

a cutter fixedly mounted on said cutter support adjacent said path between the exterior of said case and roller so as to be on the one side of said path, said cutter support being pivotable in an arc between an operative position in which said cutter extends into said path so as to cut the tape and an inoperative position in which said cutter is spaced from said path;

stopper means for stopping said cutter support from pivoting a distance away from said operative position past said inoperative position; and means for biasing said cutter support toward said inoperative position, said roller being disposed so as to be frictionally engaged by the tape to be rotated by the tape about a roller axis and pivot the cutter support into said operative position against the bias of said biasing means, when the tape is drawn along said path toward said cutter.

5. A tape dispenser as in claim 4, wherein said biasing means comprises an elastic biasing means for elastically biasing said cutter support against the portion of the tape extending along said path.

6. A tape dispenser as in claim 4, wherein said cutter support is integrally formed so as to be pivotable only about a single cutter support axis and so that said cutter and the roller axis are fixed with respect to said cutter support.

7. A tape dispenser as in claim 4, wherein said case includes an end plate having an upper edge adjacent said path and said cutter, said cutter protruding above said upper edge when said cutter support is in said operative position and receding below said upper edge when said cutter support is in said inoperative position.

8. A tape dispenser as in claim 7, wherein said cutter is disposed above a portion of said roller when said cutter support is in said operative position and below said roller when said cutter support is in said inoperative position.

9. A tape dispenser, comprising:

a case;

an integral cutter support pivotally mounted in said case;

a tape guide roller rotatably mounted on said cutter support;

tape holder means, mounted in said case, for rotatively supporting a roll of adhesive tape for rotation about a roll axis;

a cutter fixedly mounted on said cutter support between the exterior of said case and said roller, said tape holder means being mounted in said case such that the tape can be drawn along a path from the roll across said roller in frictional engagement therewith on an adhesive side of the tape so as to rotate said roller, and toward said cutter with the adhesive side of the tape opposing the cutter;

said cutter support being pivotable in an arc, about a support axis parallel to said roll axis, between an operative position in which said cutter extends toward the tape so as to cut the tape and an inoperative position in which said cutter is spaced from the tape;

stopper means for stopping said cutter support from pivoting a distance away from said operative position past said inoperative position; and means for biasing said cutter support toward the inoperative position, wherein drawing of the tape along the path across said roller and toward said cutter while pressing on said roller pivots said support toward said operative position.

10. A tape dispenser as in claim 9, wherein said biasing means comprises an elastic biasing means for elastically biasing said cutter support toward said inoperative position, whereby cutting of the tape by said cutter releases a force drawing the tape toward said cutter so that a remaining portion of the tape adhesively supported on said roller is carried by said biasing means along with said support as said biasing means urges said support to said inoperative position.

11. A tape dispenser as in claim 10, wherein said case includes an end plate having an upper edge adjacent said path and said cutter, said cutter protruding above said upper edge when said cutter support is in said operative position and receding below said upper edge when said cutter support is in said inoperative position.

12. A tape dispenser as in claim 11, wherein said cutter is disposed above a position of said roller when said cutter support is in said operative position and below said roller when said cutter support is in said inoperative position.

13. A tape dispenser as in claim 9, wherein said case includes an end plate having an upper edge adjacent said path and said cutter, said cutter protruding above said upper edge when said cutter support is in said operative position and receding below said upper edge when said cutter support is in said inoperative position.

14. A tape dispenser as in claim 13, wherein said cutter is disposed above a portion of said roller when said cutter support is in said operative position and below said roller when said cutter support is in said inoperative position, so that the remaining portion of the tape springs upward away from the cutter while adhering to said roller, after being cut by the cutter.

* * * * *